US007612025B2

(12) United States Patent
Kurihara et al.

(10) Patent No.: US 7,612,025 B2
(45) **Date of Patent: *Nov. 3, 2009**

(54) LUBRICATING OIL COMPOSITION

(75) Inventors: Isao Kurihara, Yokohama (JP); Kazuhiro Yagishita, Yokohama (JP); Shouzaburou Konishi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/462,340

(22) Filed: Aug. 3, 2006

(65) Prior Publication Data

US 2006/0270567 A1 Nov. 30, 2006

Related U.S. Application Data

(63) Continuation of application No. PCT/JP2004/017826, filed on Nov. 24, 2004.

(30) Foreign Application Priority Data

Feb. 4, 2004 (JP) ..... 2004-028174

(51) Int. Cl.
*C10M 129/76* (2006.01)
*C10M 137/06* (2006.01)
*C10M 133/16* (2006.01)

(52) U.S. Cl. ..... 508/502; 508/162; 508/192

(58) Field of Classification Search ..... 508/175, 508/440, 502, 162, 192
See application file for complete search history.

(56) References Cited

U.S. PATENT DOCUMENTS

| | | | | | |
|---|---|---|---|---|---|
| 3,912,639 | A | * | 10/1975 | Adams | 508/159 |
| 5,114,602 | A | * | 5/1992 | Petrille et al. | 508/192 |
| 5,415,792 | A | * | 5/1995 | Campbell | 508/459 |
| 5,458,807 | A | | 10/1995 | Tamoto | |
| 5,567,342 | A | * | 10/1996 | Inoue et al. | 508/287 |
| 5,652,201 | A | * | 7/1997 | Papay et al. | 508/228 |
| 5,965,495 | A | | 10/1999 | Goto et al. | |
| 6,159,911 | A | * | 12/2000 | Katafuchi | 508/391 |
| 2002/0019320 | A1 | | 2/2002 | Nakazato et al. | |
| 2002/0142922 | A1 | | 10/2002 | Yagishita et al. | |
| 2004/0102335 | A1 | * | 5/2004 | Carrick et al. | 508/192 |
| 2004/0242434 | A1 | | 12/2004 | Yagishita et al. | |
| 2005/0107269 | A1 | | 5/2005 | Yagishita et al. | |

FOREIGN PATENT DOCUMENTS

| | | | |
|---|---|---|---|
| EP | 0 234 923 | A2 | 9/1987 |
| EP | 0 243 026 | A2 | 10/1987 |
| EP | 0 280 579 | A2 | 8/1988 |
| EP | 0 280 580 | A2 | 8/1988 |
| EP | 0 528 610 | A1 | 2/1993 |
| EP | 1 016 706 | A2 | 7/2000 |
| EP | 1 526 169 | A1 | 4/2005 |
| EP | 1 526 170 | A1 | 4/2005 |
| JP | 52-704 | | 1/1977 |
| JP | 62-501572 | A | 6/1987 |
| JP | 62-501917 | A | 7/1987 |
| JP | 62-243692 | A | 10/1987 |
| JP | 62-253691 | A | 11/1987 |
| JP | 63-304095 | A | 12/1988 |
| JP | 63-304096 | A | 12/1988 |
| JP | 1-500912 | A | 3/1989 |
| JP | 5-163497 | A | 6/1993 |
| JP | 6-41568 | A | 2/1994 |
| JP | 7-316577 | A | 12/1995 |
| JP | 08-048989 | A | 2/1996 |
| JP | 8-253782 | A | 10/1996 |
| JP | 09-111275 | A | 4/1997 |
| JP | 09-235579 | A | 9/1997 |
| JP | 11-269477 | A | 10/1999 |
| JP | 2000-063862 | A | 2/2000 |
| JP | 2000-192069 | A | 7/2000 |
| JP | 2000-256690 | A | 9/2000 |
| JP | 2002-53888 | A | 2/2002 |
| JP | 2002-294271 | A | 10/2002 |
| JP | 2003-041283 | A | 2/2003 |
| JP | 2003-183686 | A | 7/2003 |
| JP | 2003-277781 | A | 10/2003 |
| JP | 2003-277782 | A | 10/2003 |
| JP | 2003-277783 | A | 10/2003 |
| JP | 2004-35619 | A | 2/2004 |
| JP | 2004-35620 | A | 2/2004 |
| JP | 2004-67812 | A | 3/2004 |
| JP | 2004-83891 | A | 3/2004 |
| JP | 2005-002213 | A | 1/2005 |
| WO | 86/04601 | A1 | 8/1986 |
| WO | 86/06739 | A1 | 11/1986 |
| WO | 88/02771 | A1 | 4/1988 |
| WO | 96/37582 | A1 | 11/1996 |
| WO | 2004/013264 | A1 | 2/2004 |

* cited by examiner

*Primary Examiner*—Glenn Caldarola
*Assistant Examiner*—Jim Goloboy
(74) *Attorney, Agent, or Firm*—Panitch Schwarze Belisario & Nadel LLP

(57) ABSTRACT

Low sulfur lubricating oil compositions are provided which are extremely excellent in anti-wear properties for the valve train system of an internal combustion engine and are also excellent in long-drain properties, and thus is suitable for used in an internal combustion engine. The lubricating oil compositions comprises a lubricating base oil, (A) a specific alkali metal or alkaline earth metal salicylate and/or an overbased or basic salt of the salicylate, (B) a phosphorus-containing anti-wear agent, (C) an ashless dispersant, and (D) an ashless anti-oxidant, as the essential components, and contains boron in an amount of 0.01 to 0.15 percent by mass and sulfur in a total amount of 0.3 percent by mass or less, based on the total mass of the composition.

8 Claims, No Drawings

LUBRICATING OIL COMPOSITION

CROSS-REFERENCE TO RELATED APPLICATIONS

This application is a continuation of International Application No. PCT/JP2004/017826, filed Nov. 24, 2004, which was published in the Japanese language on Aug. 18, 2005, under International Publication No. WO 2005/075611 A1 and the disclosure of which is incorporated herein by reference.

BACKGROUND OF THE INVENTION

The present invention relates to low-sulfur lubricating oil compositions, and more particularly to those with excellent anti-wear properties and long-drain properties, suitable for internal combustion engines.

Conventionally, lubricating oils particularly for internal combustion engines are blended with additives containing sulfur and phosphorus such as zinc dialkyldithiophosphates that are extremely excellent in anti-wear and anti-oxidation properties, as substantially essential additives. However, it has been strongly demanded to further decrease the sulfur, phosphorous, and ash of the lubricating oil under the necessity of alleviating harmful effects on exhaust-gas purifying catalysts such as ternary catalysts, oxidation catalysts and NOx adsorbers and exhaust-gas after-treatment devices such as diesel particulate filters (DPF), which are equipped in internal combustion engines in conformity with recent environment-related issues.

Examples of low phosphorus or phosphorus free oils reported so far include those described in patent documents 1 to 10 below while examples of low ash oils include those described in patent documents 11 to 14 below. However, if these conventional oils are decreased in or free of zinc dithiophosphate, it is necessary to add a sulfur-containing compound in the oils in order to maintain the anti-wear properties thereof. The low ash oils contain necessarily zinc dithiophosphate. Therefore, only few lubricating oils with low sulfur, phosphorus and ash with excellent anti-wear properties have been found so far.

(Patent Document 1) Japanese Patent Laid-Open Publication No. 62-253691

(Patent Document 2) Japanese Patent Laid-Open Publication No. 1-500912

(Patent Document 3) Japanese Patent Laid-Open Publication No. 6-41568

(Patent Document 4) Japanese Patent Laid-Open Publication No. 63-304095

(Patent Document 5) Japanese Patent Laid-Open Publication No. 63-304096

(Patent Document 6) Japanese Patent Laid-Open Publication No. 52-704

(Patent Document 7) Japanese Patent Laid-Open Publication No. 62-243692

(Patent Document 8) Japanese Patent Laid-Open Publication No. 62-501917

(Patent Document 9) Japanese Patent Laid-Open Publication No. 62-501572

(Patent Document 10) Japanese Patent Laid-Open Publication No. 2000-63862

(Patent Document 11) Japanese Patent Laid-Open Publication No. 8-48989

(Patent Document 12) Japanese Patent Laid-Open Publication No. 8-253782

(Patent Document 13) Japanese Patent Laid-Open Publication No. 9-111275

(Patent Document 14) Japanese Patent Laid-Open Publication No. 2000-256690

The inventors of the present invention have discovered that a low sulfur lubricating oil composition containing phosphorus compounds such as zinc mono- or di-alkylphosphate, zinc dialkylmonophosphate and phosphoric acid triester was more excellent in low friction properties, high temperature detergency, oxidation stability, and base number retention properties while maintaining anti-wear properties, than those containing solely zinc dithiophosphate and had filed some patent application based on this discovery (Japanese Patent Application Nos. 2002-015351, 2001-315941, 2002-086145, 2002-086146, 2002-086147, 2002-191090, 2002-191091, and 2002-191092). However, in the case of using a salicylate-based detergent whose metal ratio is 5 or less, particularly that whose metal ratio is adjusted to be 3 or less, as a metallic detergent, a composition can be obtained which is extremely excellent in low friction properties, high temperature detergency, oxidation stability, and base number retention properties. However, it has been found out that when the content of a sulfur- and phosphorus-containing anti-wear agent such as zinc dithiophosphate is decreased or a sulfur-free phosphorus-containing anti-wear agent is used, to decrease the sulfur content, the resulting composition would not be able to exhibit sufficient anti-wear properties for the valve train of an internal combustion engine, such as anti-scuffing properties for the rocker arm pads and anti-wear properties for the cams, and these properties are significantly influenced by the difference in the structure of salicylate to be used.

BRIEF SUMMARY OF THE INVENTION

In view of the foregoing circumstances, the present invention has an object to provide a long-drain type low sulfur lubricating oil composition which contains a specific salicylate-based detergent and thus are also extremely excellent anti-wear properties.

As a result of extensive studies, the present invention was achieved on the basis of the finding that a low sulfur lubricating oil composition containing a specific salicylate, phosphorus-containing anti-wear agent, ashless dispersant, and anti-oxidant and a specific amount of boron was able to solve the above-mentioned problems.

That is, the present invention relates to a lubricating oil composition comprising a lubricating base oil, (A) an alkali metal or alkaline earth metal salicylate containing at least one type of compound selected from those represented by formula (1) below and/or an overbased or basic salt of the salicylate, (B) a phosphorus-containing anti-wear agent, (C) an ashless dispersant, and (D) an ashless anti-oxidant, as the essential components, and containing boron in an amount of 0.01 to 0.15 percent by mass and sulfur in a total amount of 0.3 percent by mass or less, based on the total mass of the composition:

(1)

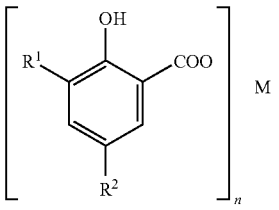

wherein $R^1$ and $R^2$ are each independently hydrogen or a hydrocarbon group having 1 to 40 carbon atoms, which hydrocarbon group may contain oxygen or nitrogen, at least either one of $R^1$ or $R^2$ is the hydrocarbon group having 1 to 40 carbon atoms, M is an alkali metal or alkaline earth metal, and n is an integer of 1 or 2 depending on the valence of the metal.

The present invention also relates to the foregoing lubricating oil composition wherein Component (A) is one or a mixture of two or more types of compounds selected from the group consisting of: (A-1) an alkali metal or alkaline earth metal salicylate wherein the component ratio of the monoalkylsalicylate having one secondary alkyl group having 10 to 40 carbon atoms is 85 percent by mol or more and the component ratio of the compound represented by formula (1) wherein $R^1$ is a secondary alkyl group having 10 to 40 carbon atoms and $R^2$ is hydrogen is 40 percent by mol or more, and/or an overbased or basic salt of the alkali metal or alkaline earth metal salicylate;

(A-2) an alkali metal or alkaline earth metal salicylate represented by formula (1) wherein $R^1$ and $R^2$ are secondary alkyl groups having 10 to 40 carbon atoms, and/or an overbased or basic salt of the alkali metal or alkaline earth metal salicylate; and (A-3) an alkali metal or alkaline earth metal salicylate represented by formula (1) wherein either one of $R^1$ or $R^2$ is a hydrocarbon group having one or more but fewer than 10 carbon atoms and the other is a secondary alkyl group having 10 to 40 carbon atoms, and the difference in carbon number between $R^1$ and $R^2$ is 10 or more, and/or an overbased basic salt of the alkali metal or alkaline earth metal salicylate.

Furthermore, the present invention relates to the foregoing lubricating oil composition wherein the boron source is Component (A) whose boron/alkali metal or alkaline earth metal mass ratio (B/M ratio) is from 0.1 to 1 and/or a boron-containing succinimide whose boron/nitrogen mass ratio (B/N ratio) is from 0.1 to 1, and the content of each component is from 0 to 0.1 percent by mass in terms of born, based on the total mass of the composition.

Furthermore, the present invention also relates to the foregoing lubricating oil composition wherein the boron-containing succinimide is bis-succinimide whose boron/nitrogen mass ratio (B/N ratio) is from 0.5 to 1.

Furthermore, the present invention also relates to the forgoing lubricating oil composition wherein Component (B) is at least one compound selected from the group consisting of phosphorus compounds represented by formulas (3) and (4), and metal salts and amine salts of these phosphorus compounds:

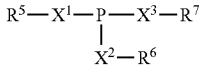

(3)

wherein $X^1$, $X^2$, and $X^3$ are each independently oxygen or sulfur, and $R^5$, $R^6$, and $R^7$ are each independently hydrogen or a hydrocarbon group having 1 to 30 carbon atoms; and

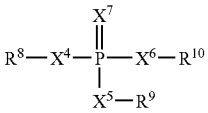

(4)

wherein $X^4$, $X^5$, $X^6$, and $X^7$ are each independently oxygen or sulfur, or one or two of $X^4$, $X^5$ and $X^6$ are a single bond or a (poly)oxyalkylene group and the other(s) and $X^7$ are oxygen or sulfur, and $R^8$, $R^9$, and $R^{10}$ are each independently hydrogen or a hydrocarbon group having 1 to 30 carbon atoms.

Furthermore, the present invention relates to the foregoing lubricating oil composition wherein Component (B) is at least one type of compound selected from the group consisting of metal salts of phosphorus compounds of formula (3) wherein all of $X^1$, $X^2$, and $X^3$ are oxygen and metal salts of phosphorus compounds of formula (4) wherein all of $X^4$, $X^5$, $X^6$, and $X^7$ are oxygen, or one or two of $X^4$, $X^5$ and $X^6$ are a single bond or a (poly)oxyalkylene group and the other(s) and $X^7$ are oxygen.

Furthermore, the present invention relates to the foregoing lubricating oil composition wherein Component (B) is a phosphorus compound of formula (4) wherein all of $X^4$, $X^5$, $X^6$, and $X^7$ are oxygen, or one or two of $X^4$, $X^5$ and $X^6$ are a single bond or a (poly)oxyalkylene group and the other(s) and $X^7$ are oxygen, and $R^8$, $R^9$, and $R^{10}$ are each independently a hydrocarbon group having 1 to 30 carbon atoms.

Furthermore, the present invention relates to the foregoing lubricating oil composition wherein Component (B) is contained in an amount of 0.08 percent by mass or less in terms of phosphorus, based on the total mass of the composition.

Furthermore, the present invention relates to the foregoing lubricating oil composition wherein it is preferably used for an internal combustion engine.

The present invention also relates to a method for preventing the rocker arms and cams in an internal combustion engine from scuffing and wearing using the foregoing lubricating oil composition.

DETAILED DESCRIPTION OF THE INVENTION

There is no particular restriction on the lubricating base oil of the lubricating oil composition of the present invention. Therefore, any conventional mineral and/or synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax).

There is no particular restriction on the sulfur content of mineral base oils as long as the total sulfur content of the composition is 0.3 percent by mass or less. However, mineral base oils contains sulfur in an amount of preferably 0.05 percent by mass or less, more preferably 0.01 percent by mass or less, and particularly preferably 0.005 percent by mass or less. A low sulfur lubricating oil composition with more excellent long drain properties can be obtained by decreasing the sulfur content of the mineral base oil. When such a lubricating oil composition is used for an internal combustion engine, it can avoid the exhaust-gas after treatment device from being adversely affected as much as possible.

Although there is no particular restriction on the total aromatic content of these mineral base oils, it is preferably 10 percent by mass or less, more preferably 6 percent by mass or less, further more preferably 3 percent by mass or less, and particularly preferably 2 percent by mass or less and may be 0 percent by mass. However, the total aromatic content is 0.4 percent by mass or more, preferably 1 percent by mass or more with the objective of the dissolubility of additives and the storage stability of the resulting composition. A lubricating oil composition with more excellent oxidation stability can be obtained by decreasing the total aromatic content of the base oil to 10 percent by mass or less.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics such as pyridines, quinolines, phenols, and naphthols.

Specific examples of synthetic base oils include polybutenes and hydrides thereof; poly-α-olefins such as 1-octene oligomer and 1-decene oligomer, and hydrides thereof, diesters such as ditridecyl glutarate, di-2-ethylhexyl adipate, diisodecyl adipate, ditridecyl adipate, and di-2-ethylhexyl cebacate; polyol esters such as neopentyl glycol ester, trimethylolpropane caprylate, trimethylolpropane pelargonate, pentaerythritol-2-ethyl hexanoate, and pentaerythritol pelargonate; aromatic synthetic oils such as alkylnaphthalenes, alkylbenzenes, and aromatic esters; and mixtures of these oils.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although there is no particular restriction on the kinematic viscosity at 100° C. of the lubricating base oil used in the present invention, it is preferably 20 $mm^2/s$ or lower, more preferably 10 $mm^2/s$ or lower, or preferably 1 $mm^2/s$ or higher, more preferably 2 $mm^2/s$ or higher. A lubricating base oil with a kinematic viscosity at 100° C. exceeding 20 $mm^2/s$ is not preferable because the low temperature viscosity characteristics of the resulting lubricating oil composition would be deteriorated, while that with a kinematic viscosity at 100° C. of lower than 1 $mm^2/s$ is not also preferable because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, when it is measured by NOACK evaporation analysis. A lubricating base oil with a NOACK evaporation loss exceeding 20 percent by mass is not preferable because the resulting lubricating oil composition would be large in evaporation loss of the base oil and the sulfur compounds, phosphorus compounds or metals in the composition would accumulate on an exhaust gas purifying device together with the base oil if the composition is used as an internal combustion engine lubricating oil and thus would adversely affect the exhaust gas purifying performance. The term "NOACK evaporation" used herein denotes the evaporation loss measured in accordance with ASTM D 5800.

Although there is no particular restriction on the viscosity index of the lubricating base oil used, it is preferably 80 or higher, more preferably 100 or higher, and further more preferably 120 or higher so as to be able to obtain excellent viscosity characteristics ranging from low temperatures to high temperatures. There is no particular restriction on the upper limit of the viscosity index. Therefore, the lubricating base oil may be any of those with a viscosity index of 135 to 180, such as n-paraffin, slack wax, GTL wax, and isoparaffin-based mineral oils obtained by isomerizing any of these or any of those with a viscosity index of 150 to 250, such as complex ester base oils and HVI-PAO base oils. A lubricating base oil with a viscosity index of less than 80 is not preferable because the low temperature viscosity characteristics of the resulting lubricating oil composition would be deteriorated.

Component (A) of the lubricating oil composition of the present invention is an alkali metal or alkaline earth metal salicylate containing at least one type of compound selected from those represented by formula (1) and overbased or basic salts of the alkali metal or alkaline earth metal salicylate:

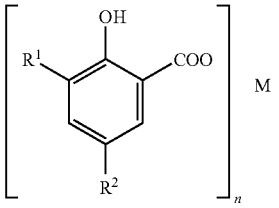

(1)

In formula (1), $R^1$ and $R^2$ are each hydrogen or a hydrocarbon group having 1 to 40 carbon atoms, which may contain oxygen or nitrogen, at least either one of $R^1$ or $R^2$ is the hydrocarbon group having 1 to 40 carbon atoms, M is an alkali metal such as sodium and potassium or an alkaline earth metal such as magnesium, barium, and calcium, and preferably magnesium and/or calcium, and n is an integer of 1 or 2 depending on the valence of the metal "M".

Examples of the hydrocarbon group having 1 to 40 carbon atoms include alkyl, cycloalkyl, alkenyl, alkyl-substituted cycloalkyl, aryl, alkyl-substituted aryl, and arylalkyl groups. More specific examples include straight-chain or branched alkyl groups having 1 to 40 carbon atoms, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms, such as cyclopentyl, cyclohexyl, and cycloheptyl groups; alkylcycloalkyl groups having 6 to 10 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups, of which the alkyl groups may bond to any position of the cycloalkyl groups; straight-chain or branched alkenyl groups such as butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, octadecenyl and nonadecenyl groups, the position of which the double bonds may vary; aryl groups such as phenyl and naphtyl groups; alkylaryl groups having 7 to 10 carbon atoms, such as tolyl, xylyl, ethylphenyl, propylphenyl, and butylphenyl groups, of which the alkyl groups may be straight-chain or branched and may bond to any position of the aryl groups; and arylalkyl groups having 7 to 10 carbon atoms, such as benzyl, phenylethyl, phenylpropyl, and phenylbutyl groups, of which the alkyl groups may be straight-chain or branched. These hydrocarbon groups may contain oxygen or nitrogen.

In the present invention, the hydrocarbon groups having 1 to 40 carbon atoms are preferably secondary alkyl groups having 10 to 40 carbon atoms, derived from polymers or copolymers of ethylene, propylene, or 1-butene and particularly preferably secondary alkyl groups having 14 to 19 or 20 to 26 carbon atoms.

Component (A) is preferably one or a mixture of two or more types of compounds selected from the group consisting of the following alkali metal or alkaline earth metal salicylates (A-1) to (A-3):

(A-1) an alkali metal or alkaline earth metal salicylate wherein the component ratio of the monoalkylsalicylate having one secondary alkyl group having 10 to 40 carbon atoms is 85 percent by mol or more and the component ratio of a compound represented by formula (1) wherein $R^1$ is a secondary alkyl group having 10 to 40 carbon atoms and $R^2$ is hydrogen is 40 percent by mol or more, and/or an overbased basic salt of the alkali metal or alkaline earth metal salicylate;

(A-2) an alkali metal or alkaline earth metal salicylate represented by formula (1) wherein $R^1$ and $R^2$ are secondary alkyl groups having 10 to 40 carbon atoms, and/or an overbased or basic salt of the alkali metal or alkaline earth metal salicylate; and (A-3) an alkali metal or alkaline earth metal salicylate represented by formula (1) wherein either one of $R^1$ or $R^2$ is a hydrocarbon group having one or more but fewer than 10 carbon atoms and the other is a secondary alkyl group having 10 to 40 carbon atoms, and the difference in carbon number between $R^1$ and $R^2$ is 10 or more, and/or an overbased or basic salt of the alkali metal or alkaline earth metal salicylate.

Component (A-1) significantly inhibits the effect of a phosphorus anti-wear agent to avoid wear of the valve train of an internal combustion engine, particularly scuffing of the rocker arm and wear of the cam. However, the essential concept of the present invention resides in a significant improvement in the anti-wear properties of a lubricating oil composition containing Component (A-1). When Component (A-1) is selected among Components (A-1) to (A-3) to be used, it can remarkably exert the effect to improve the anti-wear properties achieved by adding a boron-containing compound.

The component ratio of the monoalkylsalicylate in Component (A-1) is 85 percent by mol or more and preferably 88 percent by mol or more and may be 100 percent by mol or may be even 95 percent by mol or less in view of the production cost. The monoalkylsalicyalte is composed of a 3-alkylsalicylate, a 4-alkylsalicylate, and a 5-alkylsalicylate. However, in the present invention, the component ratio of the 3-alkylsalicylate (a compound represented by formula (1) wherein $R^1$ is a secondary alkyl group having 10 to 40 carbon atoms and $R^2$ is hydrogen) in the salicylate of Component (A-1) is 40 percent by mol or more, preferably 50 percent by mol or more, and more preferably 60 percent by mol or more or may be 100 percent by mol but even may be 95 percent by mole or less in view of the production cost. When the component ratio of the 3-alkylsalicylate is 80 percent by mol or less, 60 percent by mol or less, or particularly 55 percent by mol or less, i.e., the component ratio of the salicylate having no substituent at the 3-position, such as 4-alkylsalicylate or 5-alkylsalicylate is 5 percent by mol or more, particularly 20 percent by mol or more, and $R^1$ is a secondary alkyl group having fewer than 20 carbon atoms, the resulting composition would not exhibit sufficiently anti-wear properties such as anti-scuffing properties for the rocker arm and anti-wear properties for the cam, in an internal combustion engine, unless the composition contains a boron-containing compound in a prescribed amount, depending on the selection or amount of Component (B) if decreased. Therefore, the component structure of the lubricating oil composition of the present invention containing Component (A) and further a boron-containing compound is particularly effective for improving the anti-wear properties. The higher the component ratio of the 3-alkylsalicylate is or by increasing the carbon number of the secondary alkyl group to 20 or more, the anti-wear properties are improved even not using a boron-containing compound. However, the anti-wear properties are further improved or the content of Component (B) can be further decreased to for example 0.05 percent by mass or less in terms of phosphorus, by adding a boron-containing compound. Component (A-1) whose component ratio of the 3-alkylsalicylate is less than 40 percent by mol is not preferable because the component ratio of the 5-alkylsalicylate is relatively increased and thus the resulting composition becomes poor in oil solubility.

In Component (A-2), $R^1$ and $R^2$ are secondary alkyl groups having 10 to 40 carbon atoms and may be the same or different from each other but are preferably secondary alkyl groups derived from the same olefin in view of the production. When Component (A-2) is used alone, a composition with excellent anti-wear properties can be obtained even not using a boron-containing compound. However, a boron-containing compound is preferably used because the content of Component (B) can be further decreased to for example 0.05 percent by mass or less in terms of phosphorus. When Components (A-1) and (A-2) are used in combination, it is preferable that the component ratio of (A-2) be adjusted to be 10 percent by mol or more, preferably 20 percent by mol or more, and particularly preferably 40 percent by mol or more with the objective of further improving the anti-wear properties of the resulting lubricating oil composition.

In Component (A-3), the difference in carbon number between $R^1$ and $R^2$ is 10 or more, either one of $R^1$ or $R^2$ is a hydrocarbon group having one or more but fewer than 10 carbon atoms, preferably a hydrocarbon group having 1 to 5 carbon atoms, more preferably an alkyl group such as methyl and tertiary butyl groups, and particularly preferably a methyl group and the other is a secondary alkyl group having 10 to 40 carbon atoms and preferably a secondary alkyl group having 10 to 30 carbon atoms, and most preferably $R^1$ is a secondary alkyl group having 10 to 40 carbon atoms and $R^2$ is a hydrocarbon group having one or more but fewer than 10 carbon atoms. The hydrocarbon group having one or more but fewer than 10 carbon atoms may contain oxygen or nitrogen and thus may be a carboxyl group, i.e., —COOH group derived from a carboxylic acid having one or more but fewer than 10 carbon atoms. When Component (A-3) is used alone, a lubricating oil composition with excellent anti-wear properties can be obtained even not using a boron-containing compound. However, a boron-containing compound is preferably used because the content of Component (B) can be further decreased to for example 0.05 percent by mass or less in terms of phosphorus. When Components (A-1) and (A-3) are used in combination, the component ratio of (A-3) is adjusted to be 10 percent by mol or more, preferably 20 percent by mol or more, and particularly preferably 30 percent by mol or more with the objective of the further improving the anti-wear properties of the composition.

In the present invention, the total component ratio of the salicylates having a substituent at the 3-position is at least preferably 55 percent by mol or more, more preferably 60 percent by mol or more, even more preferably 65 percent by mol or more, and particularly preferably 70 percent by mol or more.

There is no particular restriction on the method of producing Component (A) which thus may be produced by any of known methods. For example, Component (A-1) may be produced by the following method. An alkylsalicylic acid containing a monoalkylsalicylic acid as the main component is obtained by alkylating 1 mol of a phenol using 1 mol of an olefin such as an ethylene polymer having 10 to 40 carbon atoms, and then carboxylating the alkylated phenol using carbon dioxide gas, or alternatively by alkylating 1 mol of salicylic acid using 1 mol of such an olefin. The alkylsalicylic acid is then reacted with a metal base such as an alkali metal or alkaline earth metal oxide or hydroxide or converted to an alkali metal salt such as sodium salt or potassium salt, which alkali metal salt may be further substituted with an alkaline earth metal.

Components (A-2) and (A-3) may be produced by any of known methods as disclosed in Japanese Patent Publication Nos. 48-35325 and 50-3082.

Specifically, Component (A-2) may be obtained by the above-described method for Component (A-1) wherein, however, 1.1 to 4 mol, preferably 2 to 3 mol, and particularly preferably 2 to 2.5 mol of the olefin is used instead of 1 mol of the olefin.

Specifically, Component (A-3) may be obtained by the following method. The starting material such as orthocresol or paracresol, or ortho-t-butylphenol or para-t-butylphenol is alkylated selectively at the para- or ortho-position using an olefin such as an ethylene polymer having 10 to 40 carbon atoms and preferably 10 to 30 carbon atoms so as to obtain 3-methyl-5-alkylphenol or 3-alkyl-5-methylphenol, or 3-t-butyl-5-alkylphenol or 3-alkyl-5-t-butylphenol, which is then carboxylated using carbon dioxide gas, thereby obtaining an alkylsalicylic acid. Thereafter, the alkylsalicylic acid is reacted with a metal base such as an alkali metal or alkaline earth metal oxide or hydroxide or converted to an alkali metal salt such as sodium and potassium salts, which alkali metal salt may be further substituted with an alkaline earth metal thereby obtaining Component (A-3).

Component (A) of the present invention also include basic salts obtained by heating the above-described alkali metal or alkaline earth metal salicylates (neutral salts) with an excess amount of an alkali metal or alkaline earth metal salt or an alkali metal or alkaline earth metal base (alkali metal or alkaline earth metal hydroxide or oxide) in the presence of water; and overbased salts obtained by reacting these neutral salts with a base such as an alkali metal or alkaline earth metal hydroxide in the presence of carbon dioxide gas, boric acid or borate. These reactions are generally carried out in a solvent (aliphatic hydrocarbon solvents such as hexane, aromatic hydrocarbon solvents such as xylene, and light lubricating base oil). It is preferable to use a solvent whose metal content is within the range of 1.0 to 20 percent by mass and preferably 2.0 to 16 percent by mass.

In the present invention, the base number of Component (A) is usually from 0 to 500 mgKOH/g and preferably 20 to 450 mgKOH/g. Component (A) may be one or more types of those whose base number is within these ranges. The term "base number" used herein denotes a base number measured by the perchloric acid potentiometric titration method in accordance with section 7 of JIS K2501 "Petroleum products and lubricants-Determination of neutralization number".

There is no particular restriction on the metal ratio of Component (A). Generally, one or more types of those with a metal ratio of 20 or less may be used for Component (A). It is particularly preferable to use a salicylate whose metal ratio is 5 or less, preferably 3 or less, more preferably 2.3 or less, and particularly preferably 1.5 or less because of its excellent oxidation stability, high temperature detergency, and low friction properties. When Component (A-1) with a metal ratio of 5 or less, particularly 3 or less and one secondary alkyl group having fewer than 20 carbon atoms is used, the resulting composition would not exhibit sufficiently anti-wear properties as described above if a boron-containing compound is not used. Therefore, the lubricating oil composition with Component (A-1) whose metal ratio is adjusted to 5 or less is extremely useful for improving anti-wear properties.

The term "metal ratio" used herein is represented by "valence of metal element x metal element content (mol %)/soap group content (mol %) in a salicylate-based detergent" wherein the metal element is calcium, magnesium, or the like and the soap group is a salicylic acid group, or the like.

In the present invention, the upper limit content of Component (A) is 0.5 percent by mass or less, in terms of metal based on the total mass of the composition. Furthermore, in order to decrease the sulfated ash content of the composition to 1.0 percent by mass or less, the content of Component (A) is preferably 0.3 percent by mass or less in terms of metal. When the lubricating oil composition of the present invention is used for an internal combustion engine equipped with an exhaust-gas after-treatment device, the content of Component (A) is 0.2 percent by mass or less, preferably 0.15 percent by mass or less, and most preferably 0.10 percent by mass or less in terms of metal so as to avoid harmful influences on the device as much as possible thereby obtaining a lubricating oil composition whose sulfated ash content is 0.5 percent by mass or less. The lower limit content of Component (A) is 0.005 percent by mass or more, preferably 0.01 percent by mass or more, more preferably 0.02 percent by mass or more, and particularly preferably 0.05 percent by mass or more in terms of metal based on the total mass of the composition. Component (A) exceeding the above-described upper limit increase the sulfated ash content of the composition and may adversely affect the exhaust-gas after-treatment device of an internal combustion engine when the composition is used therefor. Component (A) of less than the above-described lower limit can not exhibit its basic performance characteristics as a metallic detergent, resulting in a lubricating oil composition which fails to exhibit high temperature detergency and long drain properties such as oxidation stability and base number retention properties. The sulfated ash content used herein is a value measured by a method described by "Testing Methods for Sulfated Ash" stipulated in JIS K 2272 5. and mainly originates from metal-containing additives.

Component (A) is preferably a boron-containing overbased salicylate because it can extremely improve the anti-wear properties for a valve train, compared with a boron-free overbased salicylate. In this case, the boron content in Component (A) is preferably 0.01 percent by mass or more, more preferably 0.02 percent by mass or more, and particularly preferably 0.05 percent by mass or more, or preferably 0.15 percent by mass or less, more preferably 0.1 percent by mass or less, and particularly preferably 0.09 percent by mass or less. When the lubricating oil composition of the present invention contains another boron-containing compound described later and sufficient anti-wear properties for a valve train can be achieved, the above-described boron-containing overbased salicylate may not be used. There is no particular restriction on the mass ratio of boron/the alkali metal or alkaline earth metal (B/M ratio) in the boron-containing overbased salicylate. However, the ratio is preferably from 0.1 to 1, more preferably from 0.2 to 0.5, and particularly preferably from 0.3 to 0.5.

Component (B) of the present invention is a phosphorus-containing anti-wear agent. There is no particular restriction on such an anti-wear agent as long as it contains phosphorus in its molecules.

Component (B) is preferably at least one type of compound selected from the group consisting of phosphorus compounds represented by formulas (3) and (4), and metal salts and amine salts thereof:

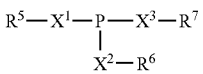

(3)

wherein $X^1$, $X^2$, and $X^3$ are each independently oxygen or sulfur, and $R^5$, $R^6$, and $R^7$ are each independently hydrogen or a hydrocarbon group having 1 to 30 carbon atoms; and

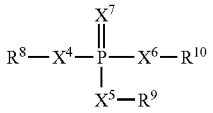

(4)

wherein $X^4$, $X^5$, $X^6$, and $X^7$ are each independently oxygen or sulfur, or one or two of $X^4$, $X^5$ and $X^6$ are a single bond, i.e., P may directly bond to R or a (poly)oxyalkylene group) and the other(s) and X7 are oxygen or sulfur, and $R^8$, $R^9$, and $R^{10}$ are each independently hydrogen or a hydrocarbon group having 1 to 30 carbon atoms.

Examples of the hydrocarbon groups having 1 to 30 carbon atoms for $R^5$ to $R^{10}$ include alkyl, cycloalkyl, alkenyl, alkyl-substituted cycloalkyl, aryl, alkyl-substituted aryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups.

Examples of the alkylcycloalkyl group include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl group include straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups, the position of which the double bonds may vary.

Examples of the aryl group include phenyl and naphthyl groups.

Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl group include those having 7 to 12 carbon atoms, such as benzyl, phenylethyl, phenylpropyl, phenylbutyl, phenylpentyl, and phenylhexyl groups, of which the alkyl groups may be straight-chain or branched.

Hydrocarbon groups having 1 to 30 carbon atoms for $R^5$ to $R^{10}$ are preferably alkyl groups having 1 to 30 carbon atoms or aryl groups having 6 to 24 carbon atoms, more preferably alkyl groups having 3 to 18 carbon atoms, and most preferably alkyl groups having 4 to 12 carbon atoms.

Examples of phosphorus compounds represented by formula (3) include phosphorous acid; monothiophosphorus acid; dithiophosphorus acid; trithiophosphorus acid; phosphorus acid monoesters, monothiophosphorus acid monoesters, dithiophosphorus acid monoesters, and trithiophosphorus acid monoesters, each having one of the above-described hydrocarbon groups having 1 to 30 carbon atoms; phosphorus acid diesters, monothiophosphorus acid diesters, dithiophosphorus acid diesters, and trithiophosphorus acid diesters, each having two of the above-described hydrocarbon groups having 1 to 30 carbon atoms; phosphorus acid triesters, monothiophosphorus acid triesters, dithiophosphorus acid triesters, and trithiophosphorus acid triesters, each having three of the above-described hydrocarbon groups having 1 to 30 carbon atoms; and mixtures thereof.

In the present invention, preferably two or more and particularly preferably all of $X^1$ to $X^3$ in formula (3) are oxygen with the objective of further improving high temperature detergency and long drain properties such as oxidation stability and base number retention properties.

Examples of phosphorus compounds represented by formula (4) include phosphoric acid; monothiophosphoric acid; dithiophosphoric acid; trithiophosphoric acid; tetrathiophosphoric acid; phosphoric acid monoesters, monothiophosphoric acid monoesters, dithiophosphoric acid monoesters, trithiophosphoric acid monoesters, and tetrathiophosphoric acid monoesters, each having one of the above-described hydrocarbon groups having 1 to 30 carbon atoms; phosphoric acid diesters, monothiophosphoric acid diesters, dithiophosphoric acid diesters, trithiophosphoric acid diesters, and tetrathiophosphoric acid diesters, each having two of the above-described hydrocarbon groups having 1 to 30 carbon atoms; phosphoric acid triesters, monothiophosphoric acid triesters, dithiophosphoric acid triesters, trithiophosphoric acid triesters, and tetrathiophosphoric acid triesters, each having three of the above-described hydrocarbon groups having 1 to 30 carbon atoms; phosphonic acid, phosphonic acid monoesters, and phosphonic acid diesters, each having one to three of the above-described hydrocarbon groups having 1 to 30 carbon atoms; the phosphoric acid compounds exemplified above but having a (poly)oxyalkylene group having 1 to 4 carbon atoms; carboxylic acid derivatives of the phosphoric acid compounds exemplified above, such as dithiophosphorylated propionic acid derivatives; and mixtures thereof.

In the present invention, preferably two or more, more preferably three or more, and particularly preferably all of $X^4$ to $X^7$ in formula (4) are oxygen with the objective of further improving high temperature detergency and long drain properties such as oxidation stability and base number retention properties. One or two of $X^4$, $X^5$ and $X^6$ may be a single bond or a (poly)oxyalkylene group.

Examples of salts of phosphorus compounds represented by formulas (3) and (4) include salts obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound and neutralize the whole or part of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkaline earth metals such as magnesium and calcium, and zinc.

The above-described metal salts of phosphorus compounds vary in structure depending on the valence of metals and the number of OH or SH group of the phosphorus compounds. Therefore, there is no particular restriction on the structure of the metal salts of phosphorus compounds. For example, when 1 mol of zinc oxide is reacted with 2 mol of a phosphoric acid monoester (with one OH group), it is assumed that a compound with a structure represented by the formula below is obtained as the main component but polymerized molecules may also exist:

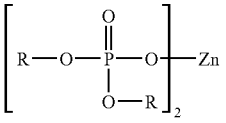

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

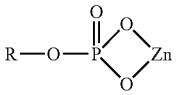

Specific examples of the nitrogen-containing compound include ammonia, monoamines, diamines, and polyamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolaamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, such as undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these nitrogen-containing compounds, preferred examples include aliphatic amines having an alkyl or alkenyl group having 10 to 20 carbon atoms, which may be straight-chain or branched, such as decylamine, dodecylamine, dimethyldodecylamine, tridecylamine, heptadecylamine, octadecylamine, oleylamine, and stearylamine.

Component (B) is preferably at least one type of compound selected from the group consisting of metal salts of phosphorus compounds represented by formula (3) wherein all of $X^1$, $X^2$, and $X^3$ are oxygen and those of phosphorus compounds represented by formula (4) wherein all of $X^4$, $X^5$, $X^6$, and $X^7$ are oxygen, or one or two of $X^4$, $X^5$, and $X^6$ are a single bond or a (poly)oxyalkylene group) and the other(s) and $X^7$ are oxygen because of its excellent high temperature detergency, long drain properties such as oxidation stability, and low-friction properties.

Component (B) is more preferably a phosphorus compound represented by formula (4) wherein all of $X^4$, $X^5$, $X^6$, and $X^7$ are oxygen, or one or two of $X^4$, $X^5$, and $X^6$ are a single bond or a (poly)oxyalkylene group) and the other(s) and $X^7$ are oxygen, and $R^8$, $R^9$, and $R^{10}$ are each independently a hydrocarbon group having 1 to 30 carbon atoms because it is excellent in long drain properties such as oxidation stability and high temperature detergency, can further improve the low-friction properties, and can further decrease the ash content.

Component (B) is further more preferably a zinc salt of a phosphorus compound represented by formula (4) wherein two of $X^4$, $X^5$, $X^6$, and $X^7$ are oxygen and the others are sulfur, or one or two of $X^4$, $X^5$, and $X^6$ are a single bond or a (poly)oxyalkylene group) and the others and $X^7$ are oxygen, two of $R^8$, $R^9$, and $R^{10}$ are hydrocarbon groups having 1 to 30 carbon atoms, and the other is hydrogen because it is excellent in anti-wear properties and can further decrease the phosphorus content.

The foregoing becomes apparent by way of referring to the above-mentioned patent applications by the inventors of the present invention.

Among Components (B) described above, preferred are salts of phosphorus acid diesters having two alkyl or aryl groups having 3 to 18 carbon atoms and zinc or calcium; phosphorus acid triesters having three alkyl or aryl groups having 3 to 18 carbon atoms, preferably three alkyl groups having 6 to 12 carbon atoms; salts of phosphoric acid monoesters having one alkyl or aryl group having 3 to 18 carbon atoms and zinc or calcium; salts of phosphoric acid diesters having two alkyl or aryl groups having 3 to 18 carbon atoms and zinc or calcium; salts of phosphonic acid monoesters having two alkyl or aryl groups having 1 to 18 carbon atoms and zinc or calcium; phosphoric acid triesters having three alkyl or aryl groups having 3 to 18 carbon atoms, preferably three alkyl groups having 6 to 12 carbon atoms; and phosphonic acid diesters having three alkyl or aryl groups having 1 to 18 carbon atoms, and most preferred are salts of phosphoric acid diesters having two alkyl or aryl groups having 3 to 18 carbon atoms and zinc (zinc dialkylphosphate).

One or more types of compounds among Components (B) may be arbitrarily blended.

There is no particular restriction on the content of Component (B) in the lubricating oil composition of the present invention. However, the content of Component (B) is 0.005 percent by mass or more, preferably 0.01 percent by mass or more and particularly preferably 0.02 percent by mass or more, or preferably 0.1 percent by mass or less and more preferably 0.08 percent by mass or less, in terms of phosphorus based on the total mass of the composition. Component (B) of less than 0.005 percent by mass in terms of phosphorus has no effect on anti-wear properties, while Component (B) of more than 0.2 percent by mass in terms of phosphorus may adversely affect an exhaust-gas after-treatment device. When Component (B) contains a sulfur-containing anti-wear agent, such as a salt of a dithiophosphoric acid diester having two alkyl or aryl groups having 3 to 18 carbon atoms and zinc (zinc dithiophosphate), there is no particular restriction on the content thereof. However, the content of the salt can be decreased to preferably 0.16 percent by mass or less, more preferably 0.1 percent by mass or less, and particularly preferably 0.08 percent by mass or less (or less than 0.08 percent by mass) because the salt maintains anti-wear properties for the valve train of an internal combustion engine well. However, it is most preferable to use a phosphorus-containing anti-wear agent containing no sulfur in the molecules because it can further improve various characteristic performances such as oxidation stability, high temperature detergency, and low friction properties. If the sulfur content of the above described zinc dithiophosphate is 0.16 percent by mass or less, particularly from 0.05 to 0.1 percent by mass, the anti-scuffing properties of the resulting composition would be deteriorated due to the interaction of Component (A), the phosphorus-containing compound, the sulfur-containing compound, and the boron-containing compound. When the sulfur content of zinc dithiophosphate is 0.05 percent by mass or less, the anti-wear properties achieved by a boron-containing compound can be significantly exhibited.

Component (C) of the lubricating oil composition of the present invention is an ashless dispersant. Component (C) may be any of ashless dispersants used in lubricating oils, such as nitrogen-containing compounds having at least one straight-chain or branched alkyl or alkenyl group having 40 to 400 carbon atoms in the molecules and derivatives thereof, and modified products of alkenyl succinimides. A mixture of any one or more of these compounds may be blended with the lubricating oil composition of the present invention.

The carbon number of the alkyl or alkenyl group is preferably from 40 to 400 and preferably from 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (C) include the following compounds, one or more of which may be used:

(C-1) succinimides having in their molecules at least one alkyl or alkenyl group having 40 to 400 carbon atoms and derivatives thereof;

(C-2) benzylamines having in their molecules at least one alkyl or alkenyl group having 40 to 400 carbon atoms and derivatives thereof; and (C-3) polyamines having in their molecules at least one alkyl or alkenyl group having 40 to 400 carbon atoms and derivatives thereof.

Specific examples of (C-1) succinimides include compounds represented by formulas (5) and (6):

(5)

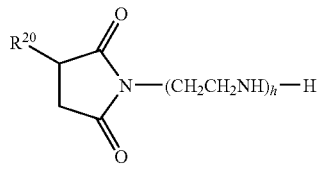

wherein $R^{20}$ is an alkyl or alkenyl group having 40 to 400 and preferably 60 to 350, and h is an integer of 1 to 5, preferably 2 to 4; and (6)

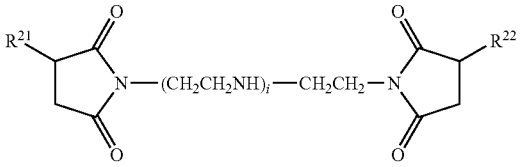

wherein $R^{21}$ and $R^{22}$ are each independently an alkyl or alkenyl group having 40 to 400, preferably 60 to 350 carbon atoms, and particularly preferably a polybutenyl group, and i is an integer of 0 to 4, preferably 1 to 3.

Succinimides include mono-type succinimides wherein a succinic anhydride is added to one end of a polyamine, as represented by formula (5) and bis-type succinimides wherein a succinic anhydride is added to both ends of a polyamine, as represented by formula (6). The lubricating oil composition may contain either type of the succinimides or mixtures thereof.

There is no particular restriction on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (C-2) benzylamines include compounds represented by formula (7):

(7)

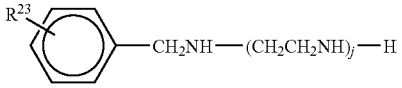

wherein $R^{23}$ is an alkyl or alkenyl group having 40 to 400, preferably 60 to 350 carbon atoms, and j is an integer of 1 to 5, preferably 2 to 4.

There is no particular restriction on the method for producing the benzylamines. They may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (C-3) polyamines include compounds represented by formula (8):

$$R^{24}—NH—(CH_2CH_2NH)_k—H \quad (20)$$

wherein $R^{24}$ is an alkyl or alkenyl group having 40 to 400 and preferably 60 to 350, and k is an integer of 1 to 5 and preferably 2 to 4.

There is no particular restriction on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Specific examples of the derivatives of the nitrogen-containing compounds exemplified as an example of Component (C) include an organic acid-modified compound obtained by allowing any of the above-described nitrogen-containing compounds to react with a monocarboxylic acid having 1 to 30 carbon atoms, such as fatty acid or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; a boron-modified compound obtained by allowing any of the above-described nitrogen-containing compounds to react with boric acid so as to neutralize or amidize the whole or part of the remaining amino and/or imino groups; a phosphoric acid-modified compound obtained by allowing any of the above-described nitrogen-containing compounds to react with phosphoric acid so as to neutralize or amidize the whole or part of the remaining amino and/or imino groups; a sulfur-modified compound obtained by allowing any of the above-described nitrogen-containing compounds to react with a sulfuric compound; and a modified product obtained by a combination of two or more selected from the modifications with an organic acid, boron, phosphoric acid, and sulfur, of the above-described nitrogen-containing compounds. Among these derivatives, boron-modified compounds of alkenylsuccinimides (boron-containing succinimide) are excellent in heat resistance, anti-oxidation properties, and anti-wear properties and thus effective for further improving the base number retention properties, high-temperature detergency and anti-wear properties of the resulting lubricating oil composition of the present invention.

When the lubricating oil composition of the present invention contains Component (C), the content thereof is from 0.01 to 20 percent by mass and preferably 0.1 to 10 percent by mass based on the total mass of the composition. Component (C) of less than 0.01 percent by mass is less effective in high temperature detergency, while Component (C) of more than 20 percent by mass deteriorates extremely the low temperature fluidity of the resulting lubricating oil composition.

There is no particular restriction on the boron/nitrogen mass ratio (B/N ratio) in the boron-containing ashless dispersant such as the above-mentioned boron-containing succinimide, which is usually from 0.05 to 5. As one embodiment of the present invention, it is preferably to use a boron-containing ashless dispersant with a B/N ratio of 0.5 or more, preferably 0.7 or more, or preferably 1 or less, more preferably 0.9 or less, preferably boron-containing succinimide, and particularly preferably boron-containing bis-succinimide. In this case, the anti-wear properties for valve trains can be extremely improved even not using another boron-containing compound. When the above-described boron-containing ashless dispersant is used, the boron content thereof is 0.01 percent by mass or more, preferably 0.02 percent by mass or more, and more preferably 0.05 percent by mass or more, or 0.15 percent by mass or less, preferably 0.1 percent by mass or less, and particularly preferably 0.09 percent by mass or less, based on the total mass of the composition.

As another embodiment concerning the boron/nitrogen mass ratio (B/N ratio) in the boron-containing ashless dispersant such as the above-mentioned boron-containing succinimide, it is preferable to use a boron-containing ashless dispersant with a B/N ratio of 0.1 or more, preferably 0.2 or more, or preferably less than 0.5, more preferably 0.4 or less, preferably boron-containing succinimide, and particularly preferably boron-containing bis-succinimide. In this case, a composition with excellent anti-wear properties for valve trains can be obtained not using another boron-containing compound in combination. However, it is more preferable to use another boron-containing compound such as Component (A) containing boron because the total boron content can be decreased while the anti-wear properties can be improved. When the above-mentioned boron-containing ashless dispersant is used, the boron content thereof is 0.01 percent by mass or more, preferably 0.02 percent by mass or more, or 0.15 percent by mass or less, preferably 0.1 percent by mass or less, more preferably 0.05 percent by mass or less, and particularly preferably 0.04 percent by mass (or less than 0.04 percent by mass).

The B/N ratio in excess of 1 is not preferable because there is a possibility that not only the resulting composition may be poor in stability but also boron is too increased and thus adversely affect the exhaust-gas after-treatment devices, together with increased sulfated ash. If the B/N ratio is less than 0.1, it is preferable to use another boron compound because the boron-containing succinimide is less effective in improving anti-wear properties.

Component (D) of the lubricating oil composition of the present invention is an ashless anti-oxidant. Component (D) may be any conventional anti-oxidant such as phenol-based anti-oxidants and amine-based anti-oxidants, which are generally used in a lubricating oil. Addition of the anti-oxidant can enhance the anti-oxidation properties of a lubricating oil composition and thus can improve the base number retention properties and high-temperature detergency of the lubricating oil composition of the present invention and also can maintain the anti-wear properties for a long period.

Examples of phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate, and 3-methyl-5-tert-butyl-4-hydroxyphenyl-substituted fatty acid esters. Mixtures of two or more of these compounds may be used.

Examples of the amine-based anti-oxidants include phenyl-α-naphtylamines, alkylphenyl-α-naphtylamines, and dialkyldiphenylamine. Two or more of these may be mixed.

The phenol-based anti-oxidant and amine-based anti-oxidant may be blended in combination.

The content of Component (D) in the lubricating oil composition is usually 20 percent by mass or less, preferably 10 percent by mass or less, and more preferably 5 percent by mass or less, based on the total mass of the composition. Component (D) of more than 20 percent by mass fails to obtain sufficient anti-oxidation properties as balanced with the content. The content of Component (D) is preferably 0.1 percent by mass or more, preferably 1 percent by mass or more, and particularly preferably 1.5 percent by mass or more in order to further enhance the high temperature detergency and long drain properties such as oxidation stability and base number retention properties during the process of deterioration of the lubricating oil.

In the case of selecting a compound insoluble or less soluble in a lubricating oil, such as zinc dialkylphosphate which is solid at ordinary temperature, from Components (B), it is particularly preferable in view of solubility of Component (B) and shortened production time of the lubricating oil composition that the compound be mixed with and dissolved in or reacted with an amine compound such as Component (C), an amine-based anti-oxidant selected from Components (D), or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and blended with a lubricating oil composition as an oil soluble additive after the solvent is vacuum-distilled (see Japanese Patent Application No. 2002-191089).

The lubricating oil composition of the present invention may contain a boron-containing compound other than those exemplified with respect to Components (A) and (C) above. Example of such a boron-containing compound include boron-containing metallic detergents such as boron-containing overbased alkaline earth metal sulfonates and boron-containing overbased alkaline earth metal phenates; boric acid esters such as boric acid triesters having a hydrocarbon group having 3 to 30 carbon atoms and derivatives thereof; and various boron-containing nitrogen compounds. There is no particular restriction on the boron content of these compounds. Therefore, any of the compounds may be blended to an extent that the total boron content of the resulting composition is in the range of 0.01 to 0.15 percent by mass.

The boron content in excess of 0.15 percent by mass in the lubricating oil composition of the present invention is less effective in improving the anti-wear properties as balanced with the content and would adversely affect the base number retention properties and high-temperature detergency because the amount of the metallic detergent is decreased due to increased sulfated ash content. The boron content of less than 0.01 percent by mass is less effective in improving the anti-wear properties.

The lubricating oil composition of the present invention is extremely excellent in anti-wear properties for valve trains because it contains the above-described Components (A) to (D) as essential components. However, if necessary, in order to further enhance the performance characteristics of the lubricating oil composition of the present invention, it may be blended with any of additives which have been used in lubricating oils, depending on purposes. Examples of such additives include metallic detergents other than Components (A), anti-wear agents other than Component (B), friction modifiers, viscosity index improvers, corrosion inhibitors, rust inhibitors, demulsifiers, metal deactivators, anti-foaming agents, and dyes.

Examples of metallic detergents other than Component (A) include alkali metal or alkaline earth metal sulfonates and alkali metal or alkaline earth metal phenates.

Examples of anti-wear agents other than Component (B) include boric acid esters and sulfur-containing compounds such as disulfides, olefin sulfides, sulfurized fats and oils, and zinc dithiocarbamate. These anti-wear agents may be blended in such an amount of 0.005 to 5 percent by mass that the total sulfur content of the composition is less than the amount as defined by present invention. However, the present invention can provide a lubricating oil composition with extremely excellent anti-wear properties even not using any of these anti-wear agents. Therefore, the present invention can produce a low sulfur lubricating oil composition with improved long drain properties by blending therewith any of the anti-wear agent in an amount of 0.15 percent by mass or less, preferably 0.1 percent by mass or less, and particularly preferably 0.05 percent by mass or less or even blending none of the anti-wear agents.

The friction modifiers may be any of compounds that are generally used as a friction modifier for a lubricating oil. Examples of such friction modifiers include molybdenum-based friction modifiers such as molybdenum dithiocarbamates, molybdenum dithiophosphate, molybdenum-amine complexes, molybdenum-succinimide complexes, and molybdenum disulfide; and ashless friction modifiers such as amine compounds, fatty acid esters, fatty acid amides, fatty acids, aliphatic alcohols, and aliphatic ethers, each having at least one alkyl or alkenyl group having 6 to 30 carbon atoms, and particularly preferably straight-chain alkyl or alkenyl group having 6 to 30 carbon atoms in the molecules. These friction modifiers may be blended in an amount of 0.1 to 5 percent by mass. The lubricating oil composition of the present invention may not contain the sulfur-containing molybdenum compounds such as molybdenum dithiocarbamates increasing the sulfated ash and sulfur contents and molybdenum dithiophosphate further increasing the phosphorus content but may contain these compounds in such an amount that the sulfur content of the composition is 0.3 percent by mass or less, more specifically in an amount in terms of sulfur of 0.15 percent by mass or less, preferably 0.1 percent by mass or less, and more preferably 0.05 percent by mass or less. The above-mentioned ashless friction modifiers such as amine compounds, fatty acid esters, or fatty acid amides may not be used but may be used for further improving the friction reducing effect.

Examples of viscosity index improvers include non-dispersion type viscosity index improvers such as polymers or copolymers of one or more monomers selected from various methacrylic acid esters or hydrides of the polymers or copolymers; dispersion type viscosity index improvers such as copolymers of various methacrylic acid esters further containing nitrogen compounds; non-dispersion- or dispersion-type ethylene-α-olefin copolymers of which the α-olefin may be propylene, 1-butene, or 1-pentene, or the hydrides thereof; polyisobutylenes or the hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount. The content of the viscosity index improver is generally from 0.1 to 20 percent by mass, based on the total mass of the composition.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β(o-carboxybenzylthio)propionitrile.

Examples of anti-foaming agents include silicone, fluorosilicone, and fluoroalkyl ethers.

When these additives are blended with the lubricating oil composition of the present invention, the content of each of the corrosion inhibitor, rust inhibitor, and demulsifier is selected from 0.005 to 5 percent by mass based on the total mass of the composition. The content of the metal deactivator is selected from 0.005 to 1 percent by mass, while the content of the anti-foaming agent is selected from 0.0005 to 1 percent by mass.

The lubricating oil composition of the present invention is a lubricating oil composition with excellent anti-wear properties, whose total sulfur content is 0.3 percent by mass or less and can be rendered a low sulfur lubricating oil composition with excellent anti-wear properties, whose total sulfur content can be decreased to preferably 0.2 percent by mass or less, more preferably 0.1 percent by mass or less, by selecting properly a lubricating base oil, Components (B), and various additives. The present invention can also provide a lubricating oil composition containing sulfur in an amount of 0.05 percent by mass or less or even 0.01 percent by mass or less or substantially no sulfur.

The sulfated ash content of the lubricating oil composition of the present invention can be decreased to 1.0 percent by mass or less, 0.8 percent by mass or less, further 0.6 percent by mass or less, and particularly 0.5 percent by mass or less by adjusting the contents of Components (A) and (B) and other metal-containing additives.

The lubricating oil composition of the present invention is a low sulfur lubricating oil composition which is excellent in not only anti-wear properties but also low friction properties, long drain properties (oxidation stability, base number retention properties) and high temperature detergency and thus can be used preferably for internal combustion engines. The lubricating oil composition can be suitably used for an internal combustion engine equipped with an exhaust-gas after treatment device by decreasing the sulfur, phosphorus and ash contents. Furthermore, the lubricating oil composition can be used suitably for internal combustion engines, particularly gasoline engines and gas engines, using a low sulfur fuel whose sulfur content is 50 ppm by mass or less, preferably 30 ppm by mass or less, and particularly preferably 10 ppm by mass or less, such as gasoline, alcohol, dimethylether, LPG or natural gas.

Furthermore, the lubricating oil composition of the present invention is suitably used as a lubricating oil required to possess any of the above-described properties, such as those for driving systems of automatic or manual transmissions, greases, wet brake oils, hydraulic oils, turbine oils, compressor oils, bearing oils, refrigerating oils, or the like.

APPLICABILITY OF THE INVENTION

The lubricating oil composition of the present invention can exhibit extremely excellent anti-wear properties and can achieve the low contents of sulfur, phosphorus, and ash as well as excellent long drain properties. Therefore, the lubricating oil composition of the present invention can be used not only as a lubricating oil for internal combustion engine but also as those required to have any of these properties, such as lubricating oils for automatic or manual transmission driving mechanisms, greases, wet brake oils, hydraulic oils, turbine oils, compressor oils, bearing oils, refrigerating oils, or the like.

BEST MODE OF CARRYING OUT THE INVENTION

Hereinafter, the present invention will be described in more details by way of the following examples and comparative examples, which should not be construed as limiting the scope of the invention.

EXAMPLES 1 to 4 AND COMPARATIVE EXAMPLES 1 TO 3

Lubricating oil compositions of the present invention (Examples 1 to 4) and those for comparison (Comparative Examples 1 to 3) were prepared as set forth in Table 1 below.

The following performance evaluation test (valve train wear test) was conducted for each of the resulting compositions.

[Valve Train Wear Test]

A valve train wear test was conducted in compliance with JASO M 328-95 using a gasoline whose sulfur content is 10 ppm or less, as a test fuel so as to measure the area of the rocker arm pad scuffing and the wear quantity of the rocker arm and cam after the lapse of 100 hours. The results are also shown in Table 1.

As apparent from the results shown in Table 1, when a monoalkylsalicylate having one secondary alkyl group having 10 or more but fewer than 20 carbon atoms (the component ratio of the 3-alkylsalicylate is 53 percent by mol, i.e., Component (A-1)) was used as Component (A) and any boron-containing compound was not used (Comparative Examples 1 to 3) were excellent in anti-wear properties for rocker arm pads but insufficient in anti-scuffing properties for rocker arm pads and anti-wear properties for cams.

On the other hand, the lubricating oil compositions of the present invention (Examples 1 to 3) were low sulfur lubricating oil compositions each of whose total sulfur content was 0.3 percent by mass or less. Even though the compositions was decreased in total sulfur content to 0.1 percent by mass or less and decreased in phosphorus content to 0.08 percent by mass or less, it was confirmed that the compositions containing 0.025 percent by mass in terms of boron of a boron-containing succinimide whose B/N ratio is 0.33 as a boron-containing compound (Examples 1 and 4), the composition containing 0.065 percent by mass in terms of boron of a boron-containing succinimide whose B/N ratio is 0.89 as a boron-containing compound (Example 2), and the composition containing 0.073 percent by mass in terms of boron of Component (A-1) (boron-containing overbased salicylate) whose B/M ratio is 0.4 (Example 3) were all significantly improved in anti-scuffing properties for rocker arm pads and anti-wear properties for cams. Particularly, the composition of Example 2 exhibited excellent anti-scuffing properties for rocker arm pads and anti-wear properties for cams. These compositions each contained boron originating from each of the boron-containing compounds in an amount of 0.1 percent by mass or less.

Furthermore, other than specific Component (A-1) having one secondary alkyl group having 10 or more but fewer than 20 carbon atoms used in the examples, when Component (A-2) or (A-3) which can provide a composition with more excellent anti-wear properties even not using a boron-containing compound in combination than the above-described (A-1) Component is used, a composition with further more excellent anti-wear properties can be obtained using a boron compound in combination. Even though Component (A-1) having a secondary alkyl group having 20 to 40 carbon atoms or Component (A-1) whose component ratio of the alkylsalicylate is larger than that of the alkylsalicylate used in Example 1 (Japanese Patent Application No. 2002-22745), a composition with further more excellent anti-wear properties can be obtained using a boron compound in combination. However, the combination of specific Component (A-1) and the boron-containing compound used in Example 1 is significant in the effect of improving the anti-wear properties and thus is extremely useful.

Alternatively, even though other components defined in the present invention, for example, Component (B), such as a phosphoric acid triester with no metal or sulfur is used, the resulting composition can be significantly improved in anti-wear properties using a boron-containing compound as well.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

TABLE 1

| | | | Example 1 | Example 2 | Example 3 | Example 4 | Comparative Example 1 | Comparative Example 2 | Comparative Example 3 |
|---|---|---|---|---|---|---|---|---|---|
| Hydrogenated refined mineral oil | 1) | mass % | balance | balance | balance | balance | balance | balance | balance |
| (A) Calcium salicylate | 2) | mass % | 3 | 3 | — | 3 | 3 | 3 | 3 |
| in terms of metal | | mass % | (0.18) | (0.18) | — | (0.18) | (0.18) | (0.18) | (0.18) |
| (A) Calcium salicylate | 3) | mass % | — | — | 2.7 | — | — | — | — |
| in terms of metal | | mass % | — | — | (0.18) | — | — | — | — |
| (B) Phosphorus-containing anti-wear agent | 4) | mass % | 0.6 | 0.6 | 0.6 | 0.3 | 0.6 | 0.3 | — |
| in terms of phosphorus | | mass % | (0.07) | (0.07) | (0.07) | (0.04) | (0.07) | (0.04) | — |
| (B) Phosphorus-containing anti-wear agent | 5) | mass % | — | — | — | 0.32 | — | 0.32 | 0.75 |
| in terms of phosphorus | | mass % | — | — | — | (0.03) | — | (0.03) | (0.07) |
| in terms of sulfur | | mass % | — | — | — | (0.06) | — | (0.06) | (0.14) |
| (D) Ashless dispersant | 6) | mass % | 5 | — | — | 5 | — | — | — |
| (D) Ashless dispersant | 7) | mass % | — | 5 | — | — | — | — | — |
| (D) Ashless dispersant | 8) | mass % | — | — | 5 | — | 5 | 5 | 5 |
| (E) Anti-oxidant | 9) | mass % | 1 | 1 | 1 | 1 | 1 | 1 | 1 |
| Other additives | 10) | mass % | 4 | 4 | 4 | 4 | 4 | 4 | 4 |
| Boron content | | mass % | 0.025 | 0.065 | 0.073 | 0.025 | 0 | 0 | 0 |
| Phosphorus content | | mass % | 0.07 | 0.07 | 0.07 | 0.07 | 0.07 | 0.07 | 0.07 |
| Sulfur content | | mass % | 0.01 | 0.01 | 0.01 | 0.07 | 0.01 | 0.07 | 0.15 |
| JASO valve train wear test | | | | | | | | | |
| Rocker arm scuffing area | | % | 5.8 | 1 | 10.3 | 18.1 | 30 | 29.2 | 11.8 |
| Rocker arm wear | | μm | 2.4 | 0.5 | 2.3 | 3.1 | 1.9 | 2.3 | 1.8 |
| Cam wear | | μm | 2.8 | 1.5 | 2.3 | 1.7 | 20.7 | 13.9 | 8.3 |

1) total aromatic content: 1.2mass %, sulfur content: 10mass ppm, kinematic viscosity at 100° C.: 5.6 $mm^2/s$, viscosity index: 125, NOACK evaporation loss: 8mass %

2) component ratio of salicylic acid: 3-alkylsalicylic acid 53 mol %; 4-alkylsalicylic acid 5 mol %; 5-alkylsalicylic acid 33 mol %; 3,5-dialkylsalicylic acid 8 mol %, 5-alkyl4-hydroxyisophtalic acid 1 mol %, alkyl group: secondary C14, C16, C18, metal ratio: 2.7, Ca content: 6.2mass %

3) component ratio of salicylic acid: 3-alkylsalicylic acid 53 mol %; 4-alkylsalicylic acid 5 mol %; 5-alkylsalicylic acid 33 mol %; 3,5-dialkylsalicylic acid 8 mol %, 5-alkyl4-hydroxyisophtalic acid 1 mol %, alkyl group: secondary C14, C16, C18, metal ratio: 2.7, Ca content: 6.8mass %, B content: 2.7mass %, B/Ca ratio: 0.4

4) zinc di(n-butyl)phosphate, phosphorus content: 13.2mass %, sulfur content: 0mass %, zinc content: 13.0mass %

5) zinc di(4-methyl-2-pentyl)dithiophosphate, phosphorus content: 9.4mass %, sulfur content: 18.8mass %

6) polybutenylsuccinimide, number-average molecular weight of polybutenyl group: 1,300, N content: 1.5mass %, B content: 0.5mass %, B/N ratio: 0.33

7) polybutenylsuccinimide, number-average molecular weight of polybutenyl group: 1,300, N content: 1.45mass %, B content: 1.3mass %, B/N ratio: 0.9

8) polybutenylsuccinimide, number-average molecular weight of polybutenyl group: 1,000, N content: 2mass %, B content: 0mass %

9) octyl-3-(3,5-di-tert-butyl-4-hydroxyphenyl)propionate and alkyldiphenyl amine (1:1)

10) OCP(average molecular weight: 150,000), demulsifier

The invention claimed is:

1. A lubricating oil composition for an internal combustion engine which comprises a lubricating base oil, (A) an alkali metal or alkaline earth metal salicylate containing at least one type of compound selected from those represented by formula (1) below and/or an overbased or basic salt of the salicylate, (B) a phosphorus-containing anti-wear agent, (C) an ashless dispersant comprising a boron-containing succinimide having a boron/nitrogen mass ratio (B/N) of 0.7 to 1, and (D) an ashless anti-oxidant, as the essential components, and containing boron in an amount of 0.01 to 0.15 percent by mass, phosphorus in an amount of greater than 0.02 to 0.08 percent by mass, and sulfur in a total amount of 0.3 percent by mass or less, based on the total mass of the composition:

(1)

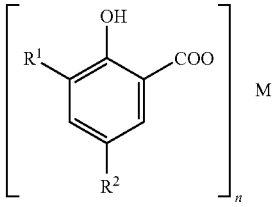

wherein $R^1$ and $R^2$ are each independently hydrogen or a hydrocarbon group having 1 to 40 carbon atoms, which hydrocarbon group may contain oxygen or nitrogen, at least either one of $R^1$ or $R^2$ is the hydrocarbon group having 1 to 40 carbon atoms, M is an alkali metal or alkaline earth metal, and n is an integer of 1 or 2 depending on the valence of the metal;

wherein Component (A) has a metal ratio of 3 or less and is (A-1) an alkali metal or alkaline earth metal salicylate wherein the component ratio of the monoalkylsalicylate having one secondary alkyl group having 10 to 40 carbon atoms is 85 percent by mol or more and the component ratio of the compound represented by formula (1) wherein $R_1$ is a secondary alkyl group having 10 to 40 carbon atoms and $R^2$ is hydrogen is 40 percent by mol or more, and/or a overbased or basic salt of the alkali metal or alkaline earth metal salicylate;

and wherein Component (B) is at least one compound selected from the group consisting of zinc salts of phosphorus compounds represented by formulas (3) and (4):

(3)

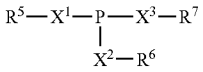

wherein $X^1$, $X^2$, and $X^3$ are each independently oxygen or sulfur, and $R^5$, $R^6$, and $R^7$ are each independently hydrogen or a hydrocarbon group having 1 to 30 carbon atoms; and (4)

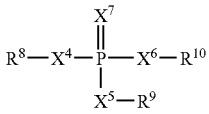

wherein $X^4$, $X^5$, and $X^6$ are each independently oxygen or sulfur, or one or two of $X^4$, $X^5$ and $X^6$ are a single bond or a (poly)oxyalkylene group and the other(s) are oxygen or sulfur, $X^7$ is oxygen, $R^8$, $R^9$, and $R^{10}$ are each independently hydrogen or a hydrocarbon group having 1 to 30 carbon atoms, and one or two of $R^8$, $R^9$, and $R^{10}$ is a hydrocarbon group.

2. The lubricating oil composition according to claim 1 wherein a boron source thereof is Component (A) having a boron/alkali metal or alkaline earth metal mass ratio (B/M ratio) of from 0.1 to 1 and/or Component (C), and the content of each component is from 0 to 0.1 percent by mass in terms of boron, based on the total mass of the composition.

3. The lubricating oil composition according to claim 2 wherein the boron-containing succinimide is bis-succinimide whose boron/nitrogen mass ratio (B/N ratio) is from 0.7 to 1.

4. The lubricating oil composition according to claim 1 wherein Component (B) is at least one type of compound selected from the group consisting of zinc salts of phosphorus compounds of formula (3) wherein all of $X^1$, $X^2$, and $X^3$ are oxygen and zinc salts of phosphorus compounds of formula (4) wherein all of $X^4$, $X^5$, $X^6$, and $X^7$ are oxygen, or one or two of $X^4$, $X^5$ and $X^6$ are a single bond or a (poly)oxyalkylene group and the other(s) and $X^7$ are oxygen.

5. A method of providing scuff and wear protection to rocker arms and cams in an internal combustion engine, which comprises lubricating the engine with a lubricating oil composition according to claim 1.

6. A method of providing scuff and wear protection to rocker arms and cams in an internal combustion engine, which comprises lubricating the engine with a lubricating oil composition according to claim 2.

7. A method of providing scuff and wear protection to rocker arms and cams in an internal combustion engine, which comprises lubricating the engine with a lubricating oil composition according to claim 3.

8. A method of providing scuff and wear protection to rocker arms and cams in an internal combustion engine, which comprises lubricating the engine with a lubricating oil composition according to claim 4.

* * * * *